United States Patent [19]

Kele

[11] Patent Number: 4,768,402

[45] Date of Patent: Sep. 6, 1988

[54] DEVICE FOR LOOSENING AND TIGHTENING THREADED BOTTLE-CAPS

[76] Inventor: Ferenc Kele, Csengery u. 9., 1074 Budapest, Hungary

[21] Appl. No.: 36,898

[22] Filed: Apr. 10, 1987

[30] Foreign Application Priority Data

Mar. 27, 1987 [HU] Hungary ..... 1350/87

[51] Int. Cl.[4] ..... B67B 7/18

[52] U.S. Cl. ..... 81/3.4

[58] Field of Search ..... 81/3.07, 3.4

[56] References Cited

U.S. PATENT DOCUMENTS

| | | | |
|---|---|---|---|
| 1,593,947 | 7/1926 | Miller et al. | 81/3.4 |
| 3,600,982 | 8/1971 | Tholen | 81/3.4 |
| 4,539,852 | 9/1985 | Feld | 81/3.4 |

*Primary Examiner*—Roscoe V. Parker

*Attorney, Agent, or Firm*—Schweitzer & Cornman

[57] ABSTRACT

A device for loosening and tightening threaded caps on the neck of bottles and bottle-like containers, the device having a body with a conically widening inner cavity dimensioned to accommodate the customary bottle cap sizes. On the inner surface of the cavity there is a thread with a pitch the direction of which is opposite to the direction of the pitch of the thread of the bottle-cap. By the aid of the thread the device is pressed onto the cap and loosens it on the bottle neck when the device is screwed onto the cap in its opening direction. In the body there is at least one longitudinal opening running parallel to the longitudinal axis of the conical cavity and a blocking element is arranged movably in said opening, however fixed against falling out, and the outer surface of the blocking element is an actuating part while the surface facing the inside of the cavity is toothed and the teeth penetrate between the threads in the cavity and slide freely along the surface of the cap in the opening direction while in the closing direction, when pressed to the cap, the edges of the teeth engage the surface of the cap and tighten it on the bottle neck.

4 Claims, 1 Drawing Sheet

DEVICE FOR LOOSENING AND TIGHTENING THREADED BOTTLE-CAPS

FIELD OF THE INVENTION

The invention relates to a device for loosening and tightening a threaded cap on the neck of a bottle or other container having bottle-like closure. The device has a conically widening inner cavity having generally the shape of a body of rotation, and accommodating the outer diameter of the various size closure caps intended to be loosened or tightened. On the inner mantle of the cavity there is a threaded surface, the direction of the pitch of which is opposite to the direction of pitch of the thread on the bottle-cap or closure, so that when the device is screwed onto the bottle-cap in its opening direction it will loosen the cap on the bottle.

BACKGROUND OF THE INVENTION

In current packaging technology bottles and other containers with bottle-like closures used generally for storing and selling liquids are of ever increasing importance. Generally two kinds of closures are used for bottles: in a simpler case the bottle is closed with a flanged cap which can be removed from the bottle only by the deformation of the cap. This is unsuitable for reclosing bottles, such as beer bottles. In other cases a thread is formed on the bottle neck and after the bottle is filled a threaded cap is screwed onto it. This screw cap often also has a collar portion that is pressed onto the bottle neck to demonstrate the untouched state of the bottle.

When opening the bottle, the cap becomes detached at the perforation from the collar that was pressed onto the bottle neck. Then the cap can be repeatedly unscrewed from, or respectively repeatedly screwed onto, the bottle.

Qualitative fluctuations in bottling technology, strength-parameters of the cap material, dimensional tolerances of the bottle and the quality of formation of perforation result in that the cap can be very often removed from the bottle only with difficulty. This causes problems even for persons with average physical strength not to mention the significant numbers of somewhat weaker juveniles and elderly people. As a consequence, many auxiliary devices became known for loosening caps that can be opened with difficulty or not at all. The common characteristic of such devices lies in that an increased turning torque can be exerted by pressing them generally onto the outer cylindrical surface of the cap and in the majority of cases the jammed cap can thus be screwed off the bottle.

A device similar to pliers is widely used in the catering trade, as well as in households for loosening the threaded caps of bottles. The curved clamping plates of this device can be pressed on the outer mantle of the cap by the aid of the grip of the device and the jammed cap can be screwed off the bottle neck when engaging it with the teeth.

The disadvantage of this device is that the plate-like clamping jaws cause an irreparable deformation or destruction of the cap and it becomes unsuitable for the repeated sealed closing of the bottle.

A device is disclosed in Hungarian Patent Specification No. 3428/84 which is suitable for undoing a threaded cap arranged on the neck of a bottle. The device is formed with a cavity having the shape of a rotary body and a geometry following that of the outer surface of a bottle cap. The cavity is open at one end and widens conically towards the open end. A conical thread is formed on the inner surface of the cavity. The direction of the pitch of the inner thread is always opposite to the direction of the pitch of the thread on the cap to be loosened. Accordingly, if the inner cavity of the device is placed onto the cap and the device is turned in the opening direction of the cap, the cap will be jammed into the inner cavity of the device, as a consequence, the cap can be easily loosened and screwed off from the bottle neck.

It is not absolutely necessary to remove the cap from the device after the bottle was opened and thus, when closing the bottle, the cap and the device together are screwed onto the bottle neck and the opener is left on the closed cap. Thereafter, by turning the device further, it can be easily removed from the cap and repeatedly installed onto the bottle neck. The device being still screwed on the bottle can also be removed from the cap when loosening by turning the device upwards from the cap.

The main disadvantage of that device is that after it is removed from the cap that is screwed back onto the bottle, the cap gradually seals less and less as it is insufficiently pressed on the bottle. Repeated putting on and taking off the cap results in its deformation to such an extent that it becomes impossible to tighten it on the bottle neck by hand. In the course of repeated contact the device begins to slide loose on the cap, and then the bottle cannot be closed with proper sealing. The deformed cap and the collar remaining on the bottle neck also can hurt the user's fingers.

The object of the present invention is to provide a device, by the aid of which the differently sized threaded caps of bottles available in commerce can be loosened or screwed-off from the bottle neck and screwed back and tightened on the bottle neck repeatedly, and in such a manner that proper sealing can be achieved each time.

BRIEF DESCRIPTION OF THE INVENTION

The present invention represents an improvement over the aforementioned prior art so that the device having a conically widening inner cavity with a threaded interior surface is provided with at least one longitudinal opening running parallel or approximately parallel to the longitudinal axis of the conical cavity. A metal tip is arranged movably in the opening, and retained therein to prevent if from falling out, the surface of the metal tip facing the inside of the cavity forms one or more teeth, while outwards it has an actuating surface, wherein, the teeth of the metal tip penetrating between the inner threads into the conical cavity are preferably bevelled and serrated in the opening direction of the device. Accordingly, the teeth can freely slide along the mantle of the cap while it is rotated in the opening direction, and when the cap is rotated in the closing direction the teeth are pressed to the cap and the edges of the teeth engage the surface of the cap and tighten it onto the neck of the bottle.

Preferably, the thread on the surface of the internal conical cavity is formed by a helical steel spring with a cross-section having a predetermined profile. The body is coaxially arranged around the spring. The body of the device is made of a synthetic material such as by injection molding. It has at least partly, the shape of a cylindrical ring. Several slots with loosely mounted gripping devices therein, can be provided to facilitate manipulation of the device. The cavity is closed at one end by a disc fixed releaseable in the device and it can carry advertising on it.

A groove each is formed on each of the two shorter parts of the metal tip between the molded synthetic activating surface of the metal tip and the corresponding toothed part. The sidewall of the body of the device extends into the groove at the bottom and the top, movably fixing the metal tip in the longitudinal opening.

The main advantage of the device according to the invention is that it is well suited not only for opening the cap, but also for closing it as often as desired and in such a manner that neither loosening, nor tightening of the cap require particular expenditure of force. The teeth of the metal tip, when engaging the cap assure the tightening of the cap in a self-looking manner.

DESCRIPTION OF THE DRAWING

The invention is described by means of a preferred embodiment, with the aid of the drawing wherein.

DETAILED DESCRIPTION OF PREFERRED EMBODIMENT

Figure 1:
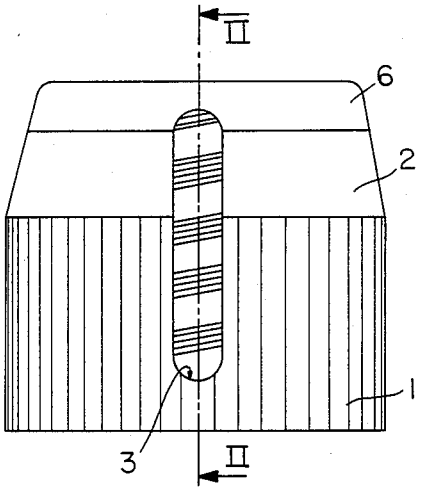
FIG. 1 is a side elevational view of a preferred embodiment of the device according to the invention without the metal tip.

As shown in FIG. 1, the illustrated embodiment has a lower cylindrical part 1, and an upper part 2 having the shape of a truncated cone. The outer surface of the lower cylindrical part 1 is knurled to avoid sliding of the fingers on the device. A longitudinal opening 3 is formed on the device parallel to the longitudinal axis of the coaxially arranged cylindrical part 1 and the part 2 of the shape of a truncated cone. The opening 3 is well suited for receiving a blocking element.

Figure 2:
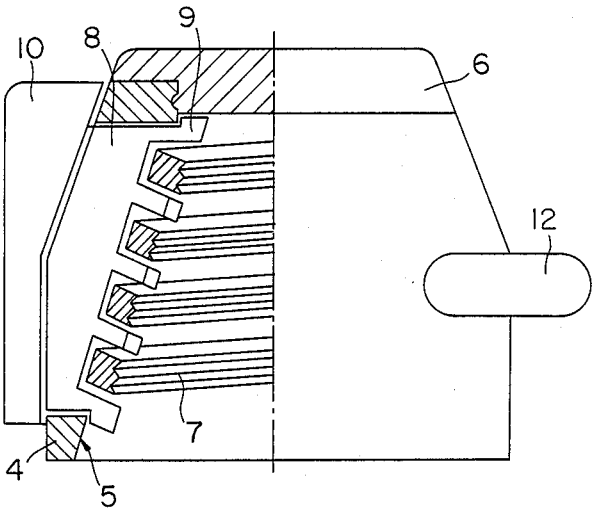
FIG. 2 is a partial cross-sectional view of the device of FIG. 1, taken along the line II—II, but including the metal tip.

As shown in FIG. 2, an inner cavity 5 is formed in a body 4 of the device. The conical dimensions of the cavity 5 are such to fit from the largest to the smallest size bottle caps that are to be loosened and tightened.

The cavity 5 widens conically towards the lower cylindrical part 1. At the top the cavity 5 is closed by a disc 6, which is releaseable fixed -in the present case snapped- into the frustoconical part 2. A thread 7 is formed projecting from the inner surface of the cavity 5. Since the device described here is for loosening and tightening caps with a right-hand thread, the thread 7 is a left-hand thread, which is formed from a helical steel spring with a profiled cross-section. A metal tip 8 is arranged in the longitudinal opening 3 of the body 4. The metal tip 8 is provided with teeth 9 which extend between the threads 7 of the inner cavity 5. The outer part of the metal tip 8 is formed as an actuating part 10 such as from a synthetic material, which protrudes throughout the length of the longitudinal opening 3, and prevents the pushing of the metal tip 8 into the inside of the device beyond a given limit. A groove 11 each is formed between the actuating part 10 of the metal tip 8 and the teeth 9, at the bottom and at the top. The width of the groove 11 is greater than the wall thickness of the body 4. Accordingly, the metal tip 8 is able to move perpendicularly to the longitudinal axis of the device and the metal tip 8 cannot fall out.

As shown in FIG. 2, the lower cylindrical part 1 of the device is not knurled as in FIG. 1, but instead a gripping extension or handle 12 protrudes from the cylindrical part 1 perpendicularly thereto, to facilitate manipulation of the device.

Figure 3:
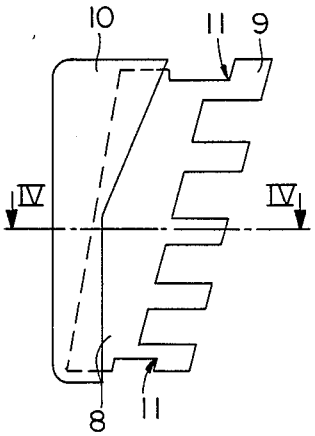
FIG. 3 is the side elevational view of the metal tip to be inserted into the longitudinal opening of the device of FIG. 1.

It can be seen in FIG. 3 that the metal tip 8 is trapezoidally shaped and it matches the conicity of the inner cavity 5 and the tread 7.

Figure 4:
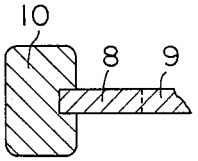
FIG. 4 is the cross-sectional view of the metal tip, taken along the line IV—IV of FIG. 3.

FIG. 4 shows that the teeth 9 of the metal tip 8 are bevelled and/or serrated in the direction of opening of the device, and therefore, they can freely slide along the surface of the cap in the opening direction, while in the closing direction the edges of the teeth 9 engage with the surface of the cap and at the same time tighten the cap onto the bottle neck.

The device according to the invention is suitably made of a synthetic material such as a polyamide e.g. danamide, by injection molding. The thread 7 can be prepared from phosphated or stainless spring steel, with a diameter of about 1.5 mm and so that 4 to 5 turns are wound on a conical mandrel after having formed the cross-sectional profile perpendicular to or parallel with the shank direction of the turn by cold deformation. The body 4 is prepared around the thread 7 thus prepared by molding in accordance with the invention and the metal tip 8 having been provided with the actuating part 10 is inserted into the longitudinal opening 3.

As a consequence of the about 0.1–0.5 mm shrinkage of the synthetic material used, the thread 7 is incorporated without turns into the body 4, while the metal tip is enclosed in a displaceable but unremovable manner in the opening 3. The metal tip is suitably a nickel-plated steel sheet, while the teeth 9 are bevelled at an angle of about 30 to 40.

The disc 6 snapped into the body 4 can carry any optional legend of advertisement which can be exchanged due to the releasability of the disk.

When loosening a cap clamped onto a bottle neck the removing device according to the invention is screwed on onto the cap in the opening direction. In the course of this process the thread 7 of the device is pressed onto the outer cylindrical surface of the cap in the area of contact. Since it is unable to slide on the cap, therefore it will turn the cap. The threads 7 are slightly cutting into the mantle of the cap, thus, when unscrewed, the cap remains in the removing device, and the cap cannot be deformed. When unscrewing the cap, the teeth 9 of the metal tip 8 slide freely along the surface of the cap without engaging it and thus destruction or deformation of the cap is avoided.

When it is intended to close the bottle, the cap is screwed on the bottle neck by obtaining a secure hold through extension 12 until there is an appreciable resistance to further tightening of the cap. At that point the actuating part 10 of the device is depressed and the device is turned further. If there are two metal tips 8 then these are preferably arranged diametrically opposite to each other in two longitudinal openings 3 of the device. The edges of the teeth 9 of the metal tip 8 are pushed towards the cap they engage the surface of the cap, the metal tip 8 assumes a self-locking position in the opening 3 and prevents sliding off of the device from the cap during further actuation. Thus the cap can be tightened and the bottle can be sealed without deformation of the cap and with a minimal expenditure of force.

In another embodiment (not shown) of the invention, the body of the opener device is provided with a plurality of conical cavities with a gradually increasing diameter. These are coaxially arranged, thus enabling loosening and tightening of caps with very small and very large diameters.

I claim:

1. A device for loosening and tightening threaded caps on bottles and like containers, which comprises a housing, said housing have a conical interior cavity for accommodating bottle caps of a variety of diameters, a threading on the surface of said cavity, said threading having a pitch which is opposite to the pitch of the threading on the bottle cap to be loosened or tightened, at least one elongated opening in said device, the elongation being parallel to the axis of said conical interior cavity, a blocking element movably disposed within said elongated opening but prevented from falling out therefrom, said blocking element having a tip force selectively positively engaging the surface of the cap while it is turned to be closed to seal the contents of the bottle or container, and for sliding freely on the surface of the cap when it is turned to be opened, said blocking element comprises a metallic tooth bevelled and/or serrated for selectively positively engaging the surface of said cap.

2. The device of claim 1, further comprising means for movably retaining said blocking element within the device.

3. The device of claim 1, wherein said threading comprises a helical steel spring having a cross section with a preselected profile, and said housing being of polymer molded around said helical steel spring.

4. The device of claim 1, wherein said housing is at least partially cylindrical in shape and has a finger hold to facilitate the turning of the device.

* * * * *